US011255227B2

(12) United States Patent
Ueda et al.

(10) Patent No.: US 11,255,227 B2
(45) Date of Patent: Feb. 22, 2022

(54) VALVE OPENING AND CLOSING TIMING CONTROL DEVICE

(71) Applicant: AISIN SEIKI KABUSHIKI KAISHA, Kariya (JP)

(72) Inventors: Kazuo Ueda, Kariya (JP); Yuji Noguchi, Kariya (JP); Hirokazu Nonogaki, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 17/110,418

(22) Filed: Dec. 3, 2020

(65) Prior Publication Data

US 2021/0172347 A1 Jun. 10, 2021

(30) Foreign Application Priority Data

Dec. 6, 2019 (JP) ..... JP2019-221342

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34426* (2013.01); *F01L 2001/34463* (2013.01)

(58) Field of Classification Search
CPC ..... F01L 1/3442; F01L 1/047; F01L 1/053; F01L 2001/34426; F01L 2001/34463; F01L 2001/34433; F01L 2001/34479; F01L 2001/34473; F01L 2001/3443; F01L 2250/02
See application file for complete search history.

(56) References Cited

U.S. PATENT DOCUMENTS

2010/0313835 A1* 12/2010 Yamaguchi ..... F01L 1/3442 123/90.15

OTHER PUBLICATIONS

U.S. Appl. No. 17/110,416, filed Dec. 3, 2020, entitled "Valve Opening and Closing Timing Control Device" and naming Kazuo Ueda, Yuji Noguchi, Yoshihiro Kawai, Masaki Kobayashi, Tomohiro Kajita, and Jaroslav Becvar as inventors.

(Continued)

*Primary Examiner* — Zelalem Eshete
(74) *Attorney, Agent, or Firm* — Buchanan Ingersoll & Rooney PC

(57) ABSTRACT

A valve opening and closing timing control device includes: a drive-side rotary body rotating synchronously with a crankshaft; a driven-side rotary body provided inside the drive-side rotary body coaxially and rotating integrally with a camshaft; advance and retard chambers formed between the drive-side and driven-side rotary bodies; a lock mechanism switchable between a lock state and a lock release state; a valve unit including a fluid supply pipe into which fluid is supplied and a spool movable along a direction of the rotation axis, and controlling supply of the fluid to and from the lock mechanism, and the advance and retard chambers; and a tubular valve case having an internal space inside the driven-side rotary body and housing the valve unit in the internal space. A first opening portion is formed in the fluid supply pipe. A second opening portion is formed in the valve case.

4 Claims, 7 Drawing Sheets

(56) References Cited

OTHER PUBLICATIONS

U.S. Appl. No. 17/122,096, filed Dec. 15, 2020, entitled "Valve Opening and Closing Timing Control Device" and naming Kazuo Ueda, Yuji Noguchi, and Masaki Kobayashi as inventors.
U.S. Appl. No. 17/110,416, filed Dec. 3, 2020, Kazuo Ueda.
U.S. Appl. No. 17/122,096, filed Dec. 15, 2020, Kazuo Ueda.

* cited by examiner

| | PA1 | PA 2 | PN | PB |
|---|---|---|---|---|
| ADVANCE CHAMBER | SUPPLY | SUPPLY | CUT OFF | DISCHARGE |
| RETARD CHAMBER | DISCHARGE | DISCHARGE | CUT OFF | SUPPLY |
| LOCK MECHANISM | DISCHARGE | SUPPLY | SUPPLY | SUPPLY |

VALVE OPENING AND CLOSING TIMING CONTROL DEVICE

CROSS REFERENCE TO RELATED APPLICATIONS

This application is based on and claims priority under 35 U.S.C. § 119 to Japanese Patent Application 2019-221342, filed on Dec. 6, 2019, the entire content of which is incorporated herein by reference.

TECHNICAL FIELD

This disclosure relates to a valve opening and closing timing control device that controls an opening and closing timing of a valve.

BACKGROUND DISCUSSION

A valve opening and closing timing control device includes a drive-side rotary body that rotates synchronously with a crankshaft of an internal combustion engine, and a driven-side rotary body that is arranged coaxially with a rotation axis of the drive-side rotary body and rotates integrally with a camshaft for opening and closing a valve. By supplying fluid to and discharging fluid from an advance chamber and a retard chamber formed between the drive-side rotary body and the driven-side rotary body, a relative rotation phase between the drive-side rotary body and the driven-side rotary body is controlled. It is known that the valve opening and closing timing control device includes a lock mechanism that can switch between a lock state in which the valve opening and closing timing control device is restrained to an intermediate phase between a most retarded phase and a most advanced phase and a lock release state in which the restraint of the intermediate phase is released (for example, see JP-A-2012-193731 (Reference 1) and JP-A-2018-91226 (Reference 2)).

In a valve opening and closing timing control device described in Reference 1, a phase control valve and a lock control valve are arranged coaxially with the rotation axis of the driven-side rotary body.

Reference 2 discloses a valve opening and closing timing control device including a valve unit that also serves as a phase control valve and a lock control valve. The valve opening and closing timing control device includes the valve unit that controls supply of fluid to and discharge of fluid from a lock mechanism, an advance chamber and a retard chamber, and a coupling bolt that houses the valve unit in an internal space that extends along the rotation axis. As the valve unit, a sleeve, a spool movable along the rotation axis direction, and a fluid supply pipe are arranged in order from an outer side to an inner side in a radial direction in the internal space of the coupling bolt. Reference 1 discloses an embodiment in which, in the lock state, a lock drain flow path through which the fluid is discharged from the lock mechanism extends along the rotation axis direction of the coupling bolt, and an advance chamber drain flow path through which the fluid is discharged from the advance chamber extends along the rotation axis direction of the coupling bolt as a flow path different from the lock drain flow path. The lock drain flow path also serves as a retard chamber drain flow path through which the fluid is discharged from the retard chamber.

The valve opening and closing timing control device described in Reference 1 operates the lock control valve independently. Accordingly, although shift to the lock state can be performed quickly, two solenoids for operating the phase control valve and the lock control valve are required, which increases a size of the device.

On the other hand, since the valve opening and closing timing control device described in Reference 2 includes the valve unit that also serves as the phase control valve and the lock control valve, a compact size of the device can be achieved. However, in the case of the valve opening and closing timing control device described in Reference 2 in which the lock drain flow path and the retard chamber drain flow path are used in common, the fluid may not be discharged smoothly from the lock mechanism. As a result, the fluid is not discharged from the lock mechanism until the relative rotation phase becomes the intermediate phase, and the lock mechanism may not be properly shifted to the lock state.

A need thus exists for a valve opening and closing timing control device which is not susceptible to the drawback mentioned above.

SUMMARY

A characteristic configuration of a valve opening and closing timing control device according to an aspect of this disclosure resides in that the valve opening and closing timing control device includes a drive-side rotary body that rotates synchronously with a crankshaft of an internal combustion engine; a driven-side rotary body that is provided inside the drive-side rotary body in a state of being coaxial with a rotation axis of the drive-side rotary body and that rotates integrally with a camshaft for opening and closing a valve; an advance chamber and a retard chamber formed between the drive-side rotary body and the driven-side rotary body; a lock mechanism that is switchable between a lock state in which a relative rotation phase of the driven-side rotary body with respect to the drive-side rotary body is restrained to an intermediate phase between a most retarded phase and a most advanced phase and a lock release state in which the restraint of the intermediate phase is released; a valve unit that includes a fluid supply pipe into which fluid is supplied and a spool movable along a direction of the rotation axis on an outer peripheral side of the fluid supply pipe, and that controls supply of the fluid to and discharge of the fluid from the lock mechanism, the advance chamber, and the retard chamber; and a tubular valve case that has an internal space extending along the rotation axis inside the driven-side rotary body in a radial direction and that houses the valve unit in the internal space. A first opening portion through which the fluid is suppliable to the advance chamber and the retard chamber is formed in the fluid supply pipe, a second opening portion that is communicative with the first opening portion through the spool and that communicates with any one of the advance chamber and the retard chamber is formed in the valve case. When the lock mechanism is in the lock state, a flow path cross-sectional area of the first opening portion communicating with the spool is smaller than a flow path cross-sectional area of the second opening portion communicating with the spool.

BRIEF DESCRIPTION OF THE DRAWINGS

The foregoing and additional features and characteristics of this disclosure will become more apparent from the following detailed description considered with the reference to the accompanying drawings, wherein.

and

Figure 8:
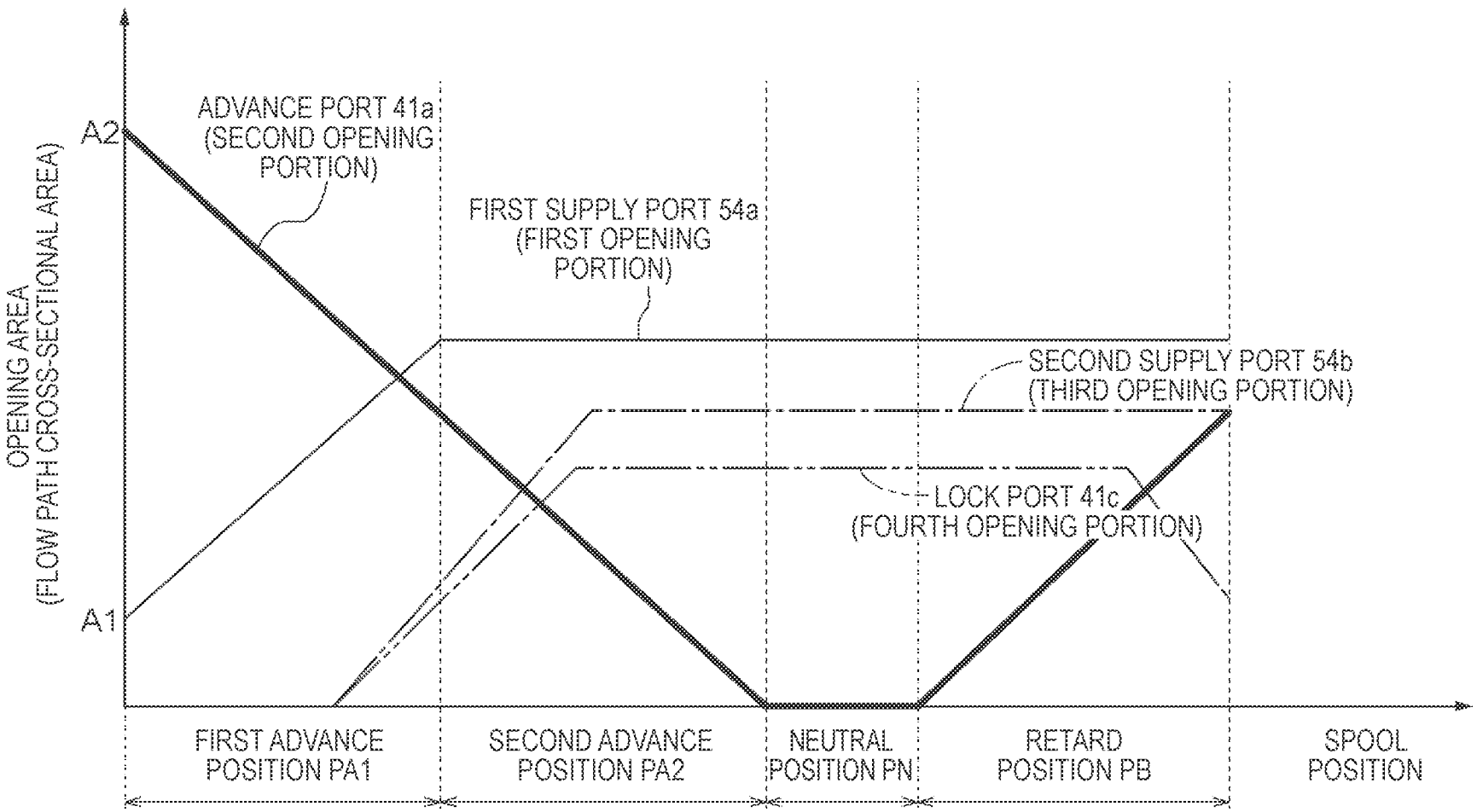

FIG. 8 is a diagram illustrating an opening area (flow path cross-sectional area) of a valve unit.

DETAILED DESCRIPTION

Embodiments of a valve opening and closing timing control device disclosed here will be described below with reference to the drawings. However, this disclosure is not limited to the following embodiments, and various modifications can be made without departing from the scope of this disclosure.

[Basic Configuration]

Figure 1:
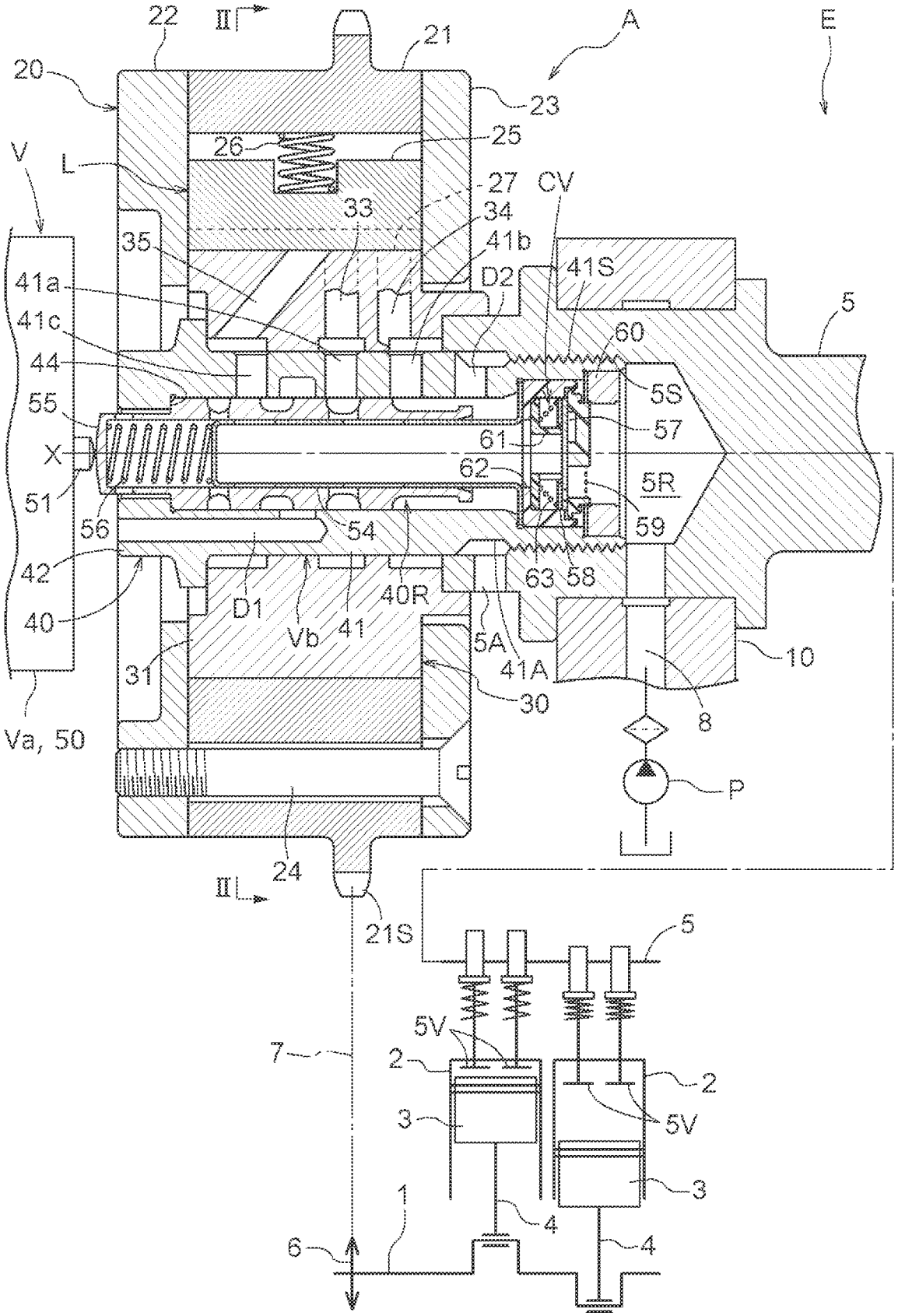
FIG. 1 is a cross-sectional view showing a valve opening and closing timing control device.
Figures 2, 3:
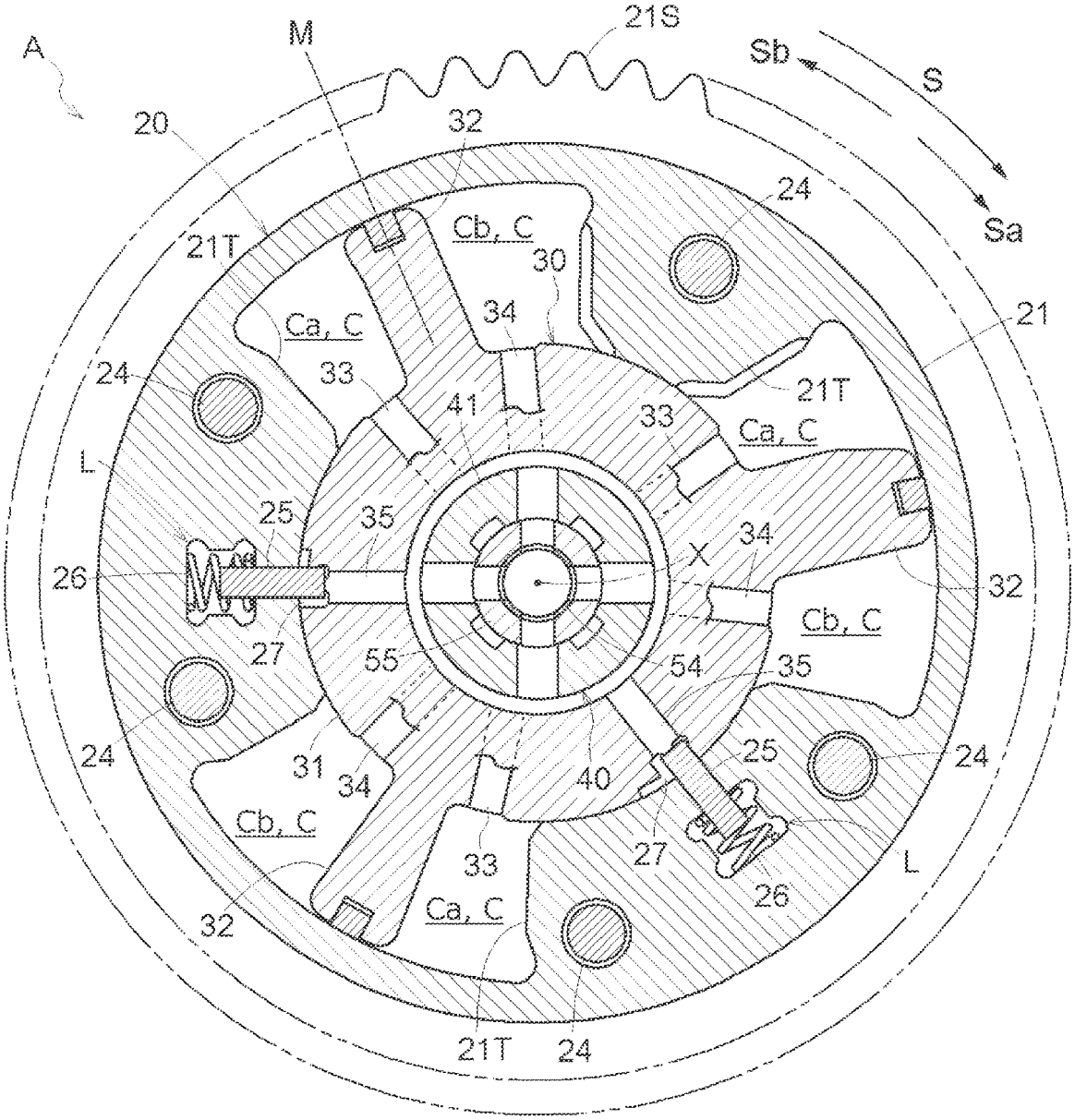
FIG. 2 is a cross-sectional view taken along a line II-II of FIG. 1.
FIG. 3 is a diagram listing a relationship between a position of a spool and supply and discharge of working oil.

As shown in FIGS. 1 and 2, a valve opening and closing timing control device A includes an external rotor 20 as a drive-side rotary body, an internal rotor 30 as a driven-side rotary body, and an electromagnetic control valve V that controls supply and discharge of working oil as a working fluid. Since the valve opening and closing timing control device A sets an opening and closing timing (opening and closing period) of an intake camshaft 5 (an example of a camshaft) of an engine E (an example of an internal combustion engine) of a vehicle such as a passenger car, the valve opening and closing timing control device A is provided coaxially with a rotation axis X of the intake camshaft 5.

The internal rotor 30 (an example of the driven-side rotary body) is arranged coaxially with the rotation axis X of the intake camshaft 5 (external rotor 20), and is integrally rotated with the intake camshaft 5 by being coupled to the intake camshaft 5 by a coupling bolt 40 (an example of a valve case). The internal rotor 30 is provided inside the external rotor 20. The external rotor 20 (an example of the drive-side rotary body) is arranged coaxially with the rotation axis X and rotates synchronously with a crankshaft 1 of the engine E. With this configuration, the external rotor 20 and the internal rotor 30 are relatively rotatable.

The valve opening and closing timing control device A includes a lock mechanism L that holds a relative rotation phase between the external rotor 20 and the internal rotor 30 (hereinafter simply referred to as "relative rotation phase") at an intermediate lock phase M (an example of an intermediate phase) shown in FIG. 2. The intermediate lock phase M is a phase between a most retarded phase and a most advanced phase. The valve opening and closing timing control device A is controlled to shift to the intermediate lock phase M at the time of stop control of the engine E as an opening and closing timing suitable for starting the engine E. The shift control to the intermediate lock phase M may be executed when the engine E is started.

The electromagnetic control valve V includes an electromagnetic unit Va and a valve unit Vb supported by the engine E.

The electromagnetic unit Va includes a solenoid portion 50 and a plunger 51 that is arranged coaxially with the rotation axis X and protrudes and retracts by drive control of the solenoid portion 50. In the valve unit Vb, a spool 55 that controls the supply and discharge of the working oil (an example of fluid) is arranged coaxially with the rotation axis X, and has a position relationship set such that a protrusion end of the plunger 51 abuts against an outer end of the spool 55.

The electromagnetic control valve V sets a protrusion amount of the plunger 51 by controlling electric power supplied to the solenoid portion 50 to operate the spool 55. By this operation, a flow of the working oil is controlled to set an opening and closing timing of an intake valve 5V, and switch between a lock state in which the lock mechanism L is restrained to the intermediate lock phase M and a lock release state in which the restraint of the intermediate lock phase M is released is performed. A configuration and a control mode of the electromagnetic control valve V will be described later.

As shown in FIG. 1, the engine E is a 4-cycle type engine in which a piston 3 is housed in a cylinder bore of a cylinder block 2 at an upper position, and the piston 3 and the crankshaft 1 are coupled by a coupling rod 4. An upper portion of the engine E includes the intake camshaft 5 for opening and closing the intake valve 5V and an exhaust camshaft (not shown).

A support member 10 that rotatably supports the intake camshaft 5 is formed with a supply flow path 8 through which the working oil is supplied from a hydraulic pump P driven by the engine E. The hydraulic pump P supplies lubricating oil stored in an oil pan of the engine E to the valve unit Vb as the working oil through the supply flow path 8.

A timing chain 7 is wound around an output sprocket 6 formed on the crankshaft 1 of the engine E and a timing sprocket 21S of the external rotor 20. Accordingly, the external rotor 20 rotates synchronously with the crankshaft 1. A sprocket is also provided at a front end of the exhaust camshaft on an exhaust side, and the timing chain 7 is also wound around the sprocket.

As shown in FIG. 2, the external rotor 20 rotates in a drive rotation direction S by a driving force from the crankshaft 1. A direction in which the internal rotor 30 rotates relative to the external rotor 20 in the same direction as the drive rotation direction S is referred to as an advance direction Sa, and a reverse direction to the direction is referred to as a retard direction Sb. In the valve opening and closing timing control device A, a relationship between the crankshaft 1 and the intake camshaft 5 is set such that an intake compression ratio is increased as a displacement amount when the relative rotation phase is displaced in the advance direction Sa increases, and the intake compression ratio is reduced as a displacement amount when the relative rotation phase is displaced in the retard direction Sb decreases.

The present embodiment describes the valve opening and closing timing control device A provided on the intake camshaft 5. The valve opening and closing timing control device A may be provided on the exhaust camshaft, and may be provided on both the intake camshaft 5 and the exhaust camshaft.

As shown in FIG. 1, the external rotor 20 includes an external rotor body 21, a front plate 22, and a rear plate 23, which are integrated by fastening a plurality of fastening bolts 24. The timing sprocket 21S is formed on an outer periphery of the external rotor body 21.

As shown in FIG. 2, a plurality of (three in the present embodiment) protrusion portions 21T protruding inward in a radial direction are integrally formed on the external rotor body 21. The internal rotor 30 includes a columnar internal rotor body 31 that is in close contact with the protrusion portions 21T of the external rotor body 21, and a plurality of vane portions 32 (three in the present embodiment) protruding outward in the radial direction from an outer periphery of the internal rotor body 31 so as to come into contact with an inner peripheral surface of the external rotor body 21.

As described above, the internal rotor 30 is provided inside the external rotor 20, and a plurality of (three in the present embodiment) fluid pressure chambers C are formed on an outer peripheral side of the internal rotor body 31 at positions between a pair of protrusion portions 21T adjacent to each other in the rotation direction. The fluid pressure chambers C are partitioned by the vane portions 32, and thus advance chambers Ca and retard chambers Cb are partitioned. Further, the internal rotor body 31 is formed with advance flow paths 33 communicating with the advance chambers Ca and retard flow paths 34 communicating with the retard chambers Cb.

As shown in FIGS. 1 and 2, the lock mechanism L includes a lock member 25 that is supported to freely protrude and retract in the radial direction with respect to each of two protrusion portions 21T of the external rotor 20, a lock spring 26 that protrudes and biases the lock member 25, and a lock recess 27 formed on the outer periphery of the internal rotor body 31. A lock control flow path 35 communicating with the lock recess 27 is formed in the internal rotor body 31.

The lock mechanism L functions to regulate the relative rotation phase to the intermediate lock phase M by simultaneously engaging two lock members 25 with corresponding lock recesses 27 by a biasing force of the lock spring 26. By supplying the working oil to the lock control flow path 35 in this lock state, the lock member 25 is disengaged from the lock recess 27 against the biasing force of the lock spring 26 to release the lock state (lock release state). Conversely, by discharging the working oil from the lock control flow path 35, the lock member 25 that receives the biasing force of the lock spring 26 is engaged with the lock recess 27 to allow the lock member 25 to shift to the lock state.

The lock mechanism L may be configured by engaging the single lock member 25 with the corresponding single lock recess 27. Further, the lock mechanism L may have a configuration in which the lock member 25 is guided so as to move along the rotation axis X direction.

[Coupling Bolt]

Figure 4:
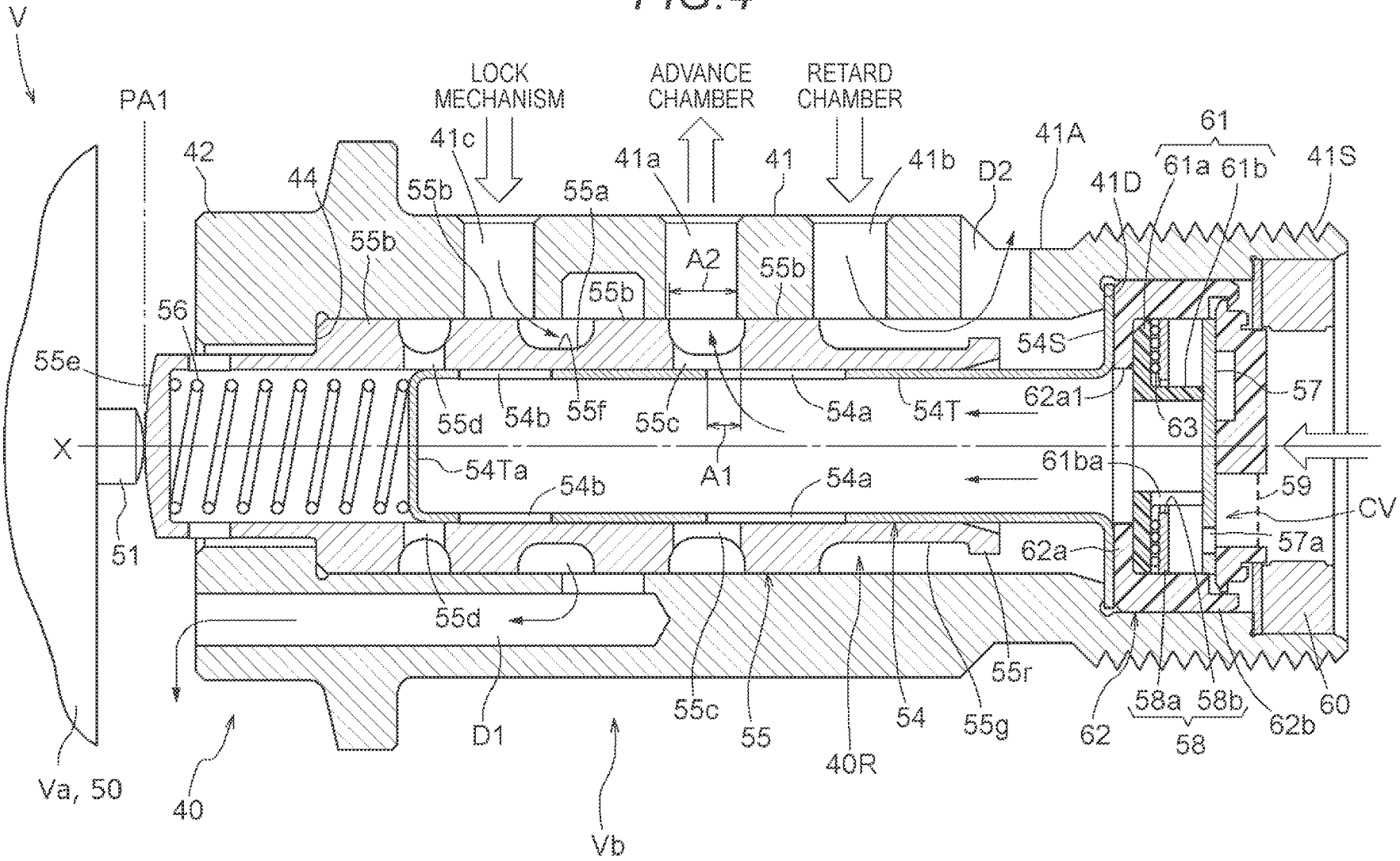
FIG. 4 is a cross-sectional view of a valve unit in which the spool is in a first advance position.

As shown in FIGS. 1 and 4, the coupling bolt 40 (an example of the valve case) integrally includes a bolt body 41 which is generally tubular and a bolt head 42 on an outer end side (left side in FIG. 4). An internal space 40R that runs in the rotation axis X direction is formed inside the coupling bolt 40, and a male screw portion 41S is formed on an outer periphery of an inner end side (right side in FIG. 4) of the bolt body 41. An annular constriction portion 41A, which is an annular groove along the outer periphery of the bolt body 41, is formed on the outer end side of the bolt body 41 adjacent to the male screw portion 41S.

As shown in FIG. 1, the intake camshaft 5 defines a shaft internal space 5R centered on the rotation axis X, and a female screw portion 5S is formed on an inner periphery of the shaft internal space 5R. The shaft internal space 5R communicates with the supply flow path 8 and is supplied with the working oil from the hydraulic pump P.

With this configuration, the bolt body 41 is inserted into the internal rotor 30, the male screw portion 41S is screwed to the female screw portion 5S of the intake camshaft 5, and the internal rotor 30 is fastened to the intake camshaft 5 by the rotation operation of the bolt head 42. By the fastening, the internal rotor 30 is fixed to the intake camshaft 5, and the shaft internal space 5R and the internal space 40R of the coupling bolt 40 (strictly, an internal space of a fluid supply pipe 54) communicate with each other.

As shown in FIG. 4, a regulation wall 44 is formed on the outer end side of the inner peripheral surface of the internal space 40R of the coupling bolt 40 in the rotation axis X direction. The regulation wall 44 protrudes in a direction of approaching the rotation axis X. The regulation wall 44 regulates a protrusion position by abutting a land portion 55*b* on an outer end side of the spool 55, which will be described later. In a region from an intermediate position of the coupling bolt 40 to an end portion on the outer end side, a plurality of (four in the present embodiment) first drain flow paths D1 are formed in an elongated hole shape with one end blocked along the rotation axis X.

In the bolt body 41, a plurality of (four in the present embodiment) lock ports 41*c* (an example of a fourth opening portion) communicating with the lock control flow path 35, a plurality of (four in the present embodiment) advance ports 41*a* (an example of a second opening portion) communicating with the advance flow path 33, and a plurality of (four in the present embodiment) retard ports 41*b* communicating with the retard flow path 34 are formed as through holes connecting the internal space 40R and the outer peripheral surface in order from the outer end side to the inner end side of the coupling bolt 40 (see also FIG. 1). On an inner end side of the retard port 41*b* of the bolt body 41, a plurality of (four in the present embodiment) second drain flow paths D2 are formed as through holes connecting the internal space 40R and the outer peripheral surface, and communicate with the annular constriction portion 41A. The annular constriction portion 41A communicates with a drain communication path 5A formed through the end portion of the intake camshaft 5, and the working oil from the second drain flow path D2 is discharged to the outside through the drain communication path 5A (see also FIG. 1). That is, in the present embodiment, due to the configuration in which the first drain flow path D1 extends in the rotation axis X direction and the second drain flow path D2 extends in the radial direction orthogonal to the rotation axis X direction, the first drain flow path D1 and the second drain flow path D2 extend in directions intersecting each other at different positions in the rotation axis X direction. The drain communication path 5A may be formed at an end portion of the internal rotor 30, or may be formed at a boundary position between the internal rotor 30 and the intake camshaft 5.

[Valve Unit]

As shown in FIGS. 1 and 4, the valve unit Vb includes the fluid supply pipe 54 that is coaxial with the rotation axis X and is housed in the internal space 40R, and the spool 55 that is freely slidable in the rotation axis X direction while being guided by the inner peripheral surface of the coupling bolt 40 and an outer peripheral surface of a pipeline portion 54T of the fluid supply pipe 54. The valve unit Vb includes a spool spring 56 as a biasing member that biases the spool 55 in the protrusion direction, a check valve CV, an oil filter 59, and a fixing ring 60.

The fluid supply pipe 54 includes the pipeline portion 54T inserted in the spool 55 and a flange-shaped base end portion 54S in which the inner end side of the pipeline portion 54T is bent in an annular shape. The pipeline portion 54T and the base end portion 54S are integrally formed. The base end portion 54S abuts on a regulation step portion 41D provided at a boundary position on the inner peripheral side between the male screw portion 41S and the annular constriction portion 41A of the coupling bolt 40. In the pipeline portion 54T, a plurality of (three in the present embodiment) first supply ports 54*a* (an example of a first opening portion) are formed near the base end portion 54S, and a plurality of (three in the present embodiment) second supply ports 54*b* (an example of a third opening portion) are formed on the outer end side of the first supply port 54*a*.

The three first supply ports 54*a* are wide in the circumferential direction and have an elongated hole shape extending in the rotation axis X direction. Four intermediate hole portions 55*c* formed in the spool 55 at positions corresponding to the first supply ports 54*a* are circular. From such a configuration, the working oil from the pipeline portion 54T can be reliably supplied to the intermediate hole portions 55*c*.

Similar to the first supply ports 54*a*, the second supply ports 54*b* also have an elongated hole shape extending in the rotation axis X direction. Four end hole portions 55*d* formed in the spool 55 at positions corresponding to the second supply ports 54*b* are circular. From such a configuration, the working oil can be reliably supplied from the pipeline portion 54T to the end hole portions 55*d*.

The spool 55 is formed with a spool body 55*a* which is tubular and has an abutting surface formed on the outer end side, and four land portions 55*b* formed on the outer periphery thereof in a protruding state. An internal flow path is formed inside the spool 55. A plurality of (four in the present embodiment) intermediate hole portions 55*c* communicating with the internal flow path are formed at an intermediate position of the pair of land portions 55*b* on an inner end side in the rotation axis X direction. A plurality of (four in the present embodiment) end hole portions 55*d* communicating with the internal flow path are formed at the intermediate position of the pair of land portions 55*b* on an outer end side in the rotation axis X direction. An intermediate annular groove 55*f* that does not communicate with the internal flow path is formed at the intermediate position of the pair of land portions 55*b* between the intermediate hole portion 55*c* and the end hole portion 55*d*. An elongated groove-shaped end annular groove 55*g* that does not communicate with the internal flow path is formed on further an inner end side of the land portion 55*b* on an innermost end side in the rotation axis X direction.

The spool 55 is formed with an abutting end portion 55*r* that abuts on the base end portion 54S of the fluid supply pipe 54 to determine an operation limit when the spool 55 is operated in a pushing direction. The abutting end portion 55*r* is provided at an end portion of a region where the spool body 55*a* is extended. Even when the spool 55 is pushed in with an excessive force, a defect that the spool 55 operates beyond the operation limit is prevented.

The spool spring 56 is a compression coil type spring, and is arranged between a bottom wall 55*e* on an outer end side of the spool 55 and a bottom wall 54Ta on an outer end side of the pipeline portion 54T of the fluid supply pipe 54. When the electric power is not supplied to the solenoid portion 50 of the electromagnetic unit Va due to an action of the biasing force, the land portion 55*b* on the outer end side abuts on the regulation wall 44 and the spool 55 is maintained at a first advance position PA1 shown in FIG. 4.

[Check Valve]

The check valve CV includes an opening plate 57 and a valve plate 58 which are formed of metal plates having an equal outer diameter, a guide member 61, a tubular member 62, and a valve spring 63. An annular opening portion 57*a* centered on the rotation axis X is formed at an outer peripheral position of the opening plate 57. A circular valve body 58*a* having a diameter larger than that of the opening portion 57*a* is arranged at the outer peripheral position of the valve plate 58, and a circular opening portion 58*b* centered on the rotation axis X is formed at a center position.

The guide member 61 includes a bottom portion 61*a* and a tubular protrusion portion 61*b* protruding from the bottom portion 61*a*. A plurality of slits 61*ba* are formed on a side wall of the protrusion portion 61*b*. The protrusion portion 61*b* is inserted into the opening portion 58*b* of the valve plate 58, and the valve plate 58 is guided by the protrusion portion 61*b* and moves. The tubular member 62 includes a bottom portion 62*a* and an annular portion 62*b* that protrudes annularly from an outer periphery of the bottom portion 62*a*. An opening portion 62*a*1 having substantially the same diameter as the inner diameter of the pipeline portion 54T of the fluid supply pipe 54 is formed at the center of the bottom portion 62*a*. The opening plate 57, the valve plate 58, the guide member 61, and the valve spring 63 are housed inside the annular portion 62*b*, and the oil filter 59 abuts on the end portion of the annular portion 62*b*.

The valve spring 63 is a compression coil type spring and is arranged between the bottom portion 61*a* of the guide member 61 and the valve body 58*a* of the valve plate 58. The check valve CV is configured such that, when pressure downstream increases or when discharge pressure of the hydraulic pump P decreases, the valve body 58*a* comes into close contact with the opening plate 57 by the biasing force of the valve spring 63 to close the opening portion 57*a*.

The oil filter 59 has a structure in which a metal net body is reinforced with a resin frame, and removes dust contained in the working oil. The fixing ring 60 is press-fitted and fixed to an inner periphery of the end portion of the coupling bolt 40, and positions of the oil filter 59, the opening plate 57, and the valve plate 58 are determined by the fixing ring 60. The tubular member 62, the guide member 61, the valve spring 63, the opening plate 57, and the valve plate 58 constituting the check valve CV are arranged in this order, the oil filter 59 is arranged in the internal space 40R so as to be further overlapped, and the fixing ring 60 is press-fitted and fixed to the inner periphery of the internal space 40R.

In this way, by fixing with the fixing ring 60, the base end portion 54S of the fluid supply pipe 54 is sandwiched and fixed between the bolt body 41 and the tubular member 62. Due to the biasing force of the spool spring 56 that abuts on the bottom wall 54Ta of the fluid supply pipe 54, the land portion 55*b* on the outer end side of the spool 55 abuts on the regulation wall 44, and a position in the rotation axis X direction is determined.

[Operation Mode]

In the valve opening and closing timing control device A, when the electric power is not supplied to the solenoid portion 50 of the electromagnetic unit Va, no pressing force acts on the spool 55 from the plunger 51, and a position of the spool 55 is maintained in a state where the land portion 55*b* at the outer side position abuts on the regulation wall 44 by the biasing force of the spool spring 56 as shown in FIG. 4.

A movement start position of the spool 55 is the first advance position PA1. By increasing the electric power supplied to the solenoid portion 50 of the electromagnetic unit Va, as shown in FIG. 3, the spool 55 can be freely operated to the second advance position PA2, the neutral position PN, and the retard position PB in this order. That is, by setting the electric power supplied to the solenoid portion 50 of the electromagnetic unit Va, the spool 55 can be operated to any one of the four operation positions. When the spool 55 is operated to the retard position PB, the spool 55 is at the movement end position that maximizes the electric power supplied to the solenoid portion 50.

Further, in the valve unit Vb, the first advance position PA1 is set to a lock position. In this lock position, the lock mechanism L can shift to the lock state. When the spool 55 is operated to one of the first advance position PA1 and the second advance position PA2, the working oil supplied from the hydraulic pump P is sent to the advance port 41*a* through the intermediate hole portion 55*c* of the spool 55, and is further supplied to the advance chamber Ca from the advance flow path 33. At the same time, the working oil in the retard chamber Cb flows from the retard flow path 34 to the retard port 41*b*, and is discharged from the second drain flow path D2 through the end annular groove 55*g* of the spool 55 to the outside through the annular constriction portion 41A and the drain communication path 5A.

In the first advance position PA1, as shown in FIG. 4, in cooperation with the supply of the working oil to the advance chamber Ca and the discharge of the working oil from the retard chamber Cb, the working oil in the lock recess 27 flows from the lock control flow path 35 to the lock port 41*c*, and is discharged from the first drain flow path D1 through the intermediate annular groove 55*f* of the spool 55. As a result, when the vane portion 32 of the internal rotor 30 moves in the advance direction Sa and reaches the intermediate lock phase M, the lock member 25 engages with the lock recess 27 by the biasing force of the lock spring 26 to be in the lock state.

Figure 5:
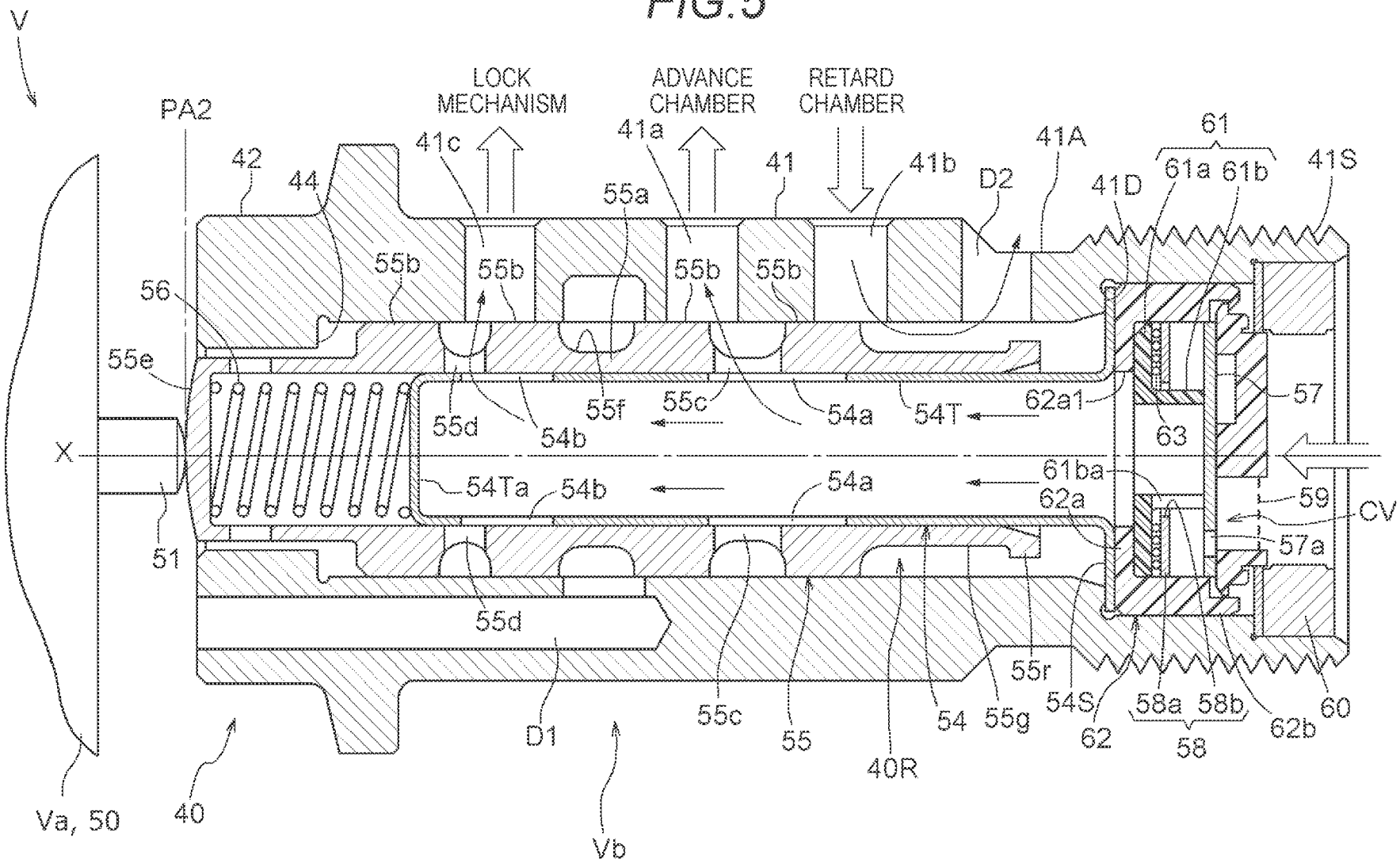
FIG. 5 is a cross-sectional view of the valve unit in which the spool is in a second advance position.

In the second advance position PA2, as shown in FIG. 5, in cooperation with the supply of the working oil to the advance chamber Ca, the working oil flows from the lock port 41*c* to the lock recess 27 through the lock control flow path 35, and the pressure of the working oil is applied to the lock member 25. As a result, the operation in the advance direction Sa is continuously performed in a state where the lock of the lock mechanism L is released.

Figure 6:
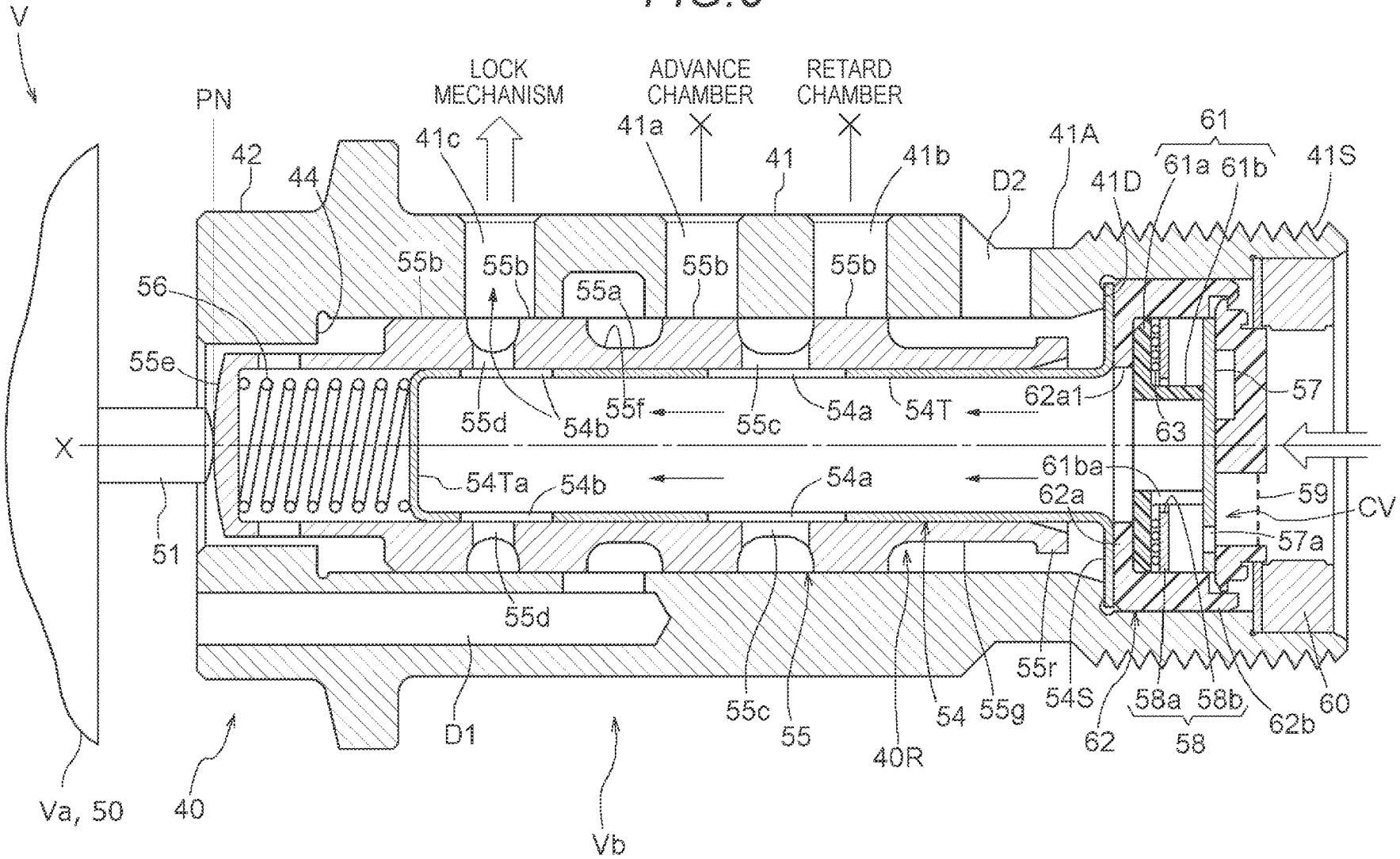
FIG. 6 is a cross-sectional view of the valve unit in which the spool is in a neutral position.

When the spool 55 is operated to the neutral position PN, as shown in FIG. 6, the pair of land portions 55*b* are in such a position relationship that the advance port 41*a* and the retard port 41*b* are closed, and the supply and discharge of the working oil to the advance chamber Ca and the retard chamber Cb are cut off, and the relative rotation phase is maintained. In the neutral position PN, the working oil flows from the lock port 41*c* to the lock recess 27 through the lock control flow path 35, the pressure of the working oil is applied to the lock member 25, and the state where the lock of the lock mechanism L is released continues.

Figure 7:
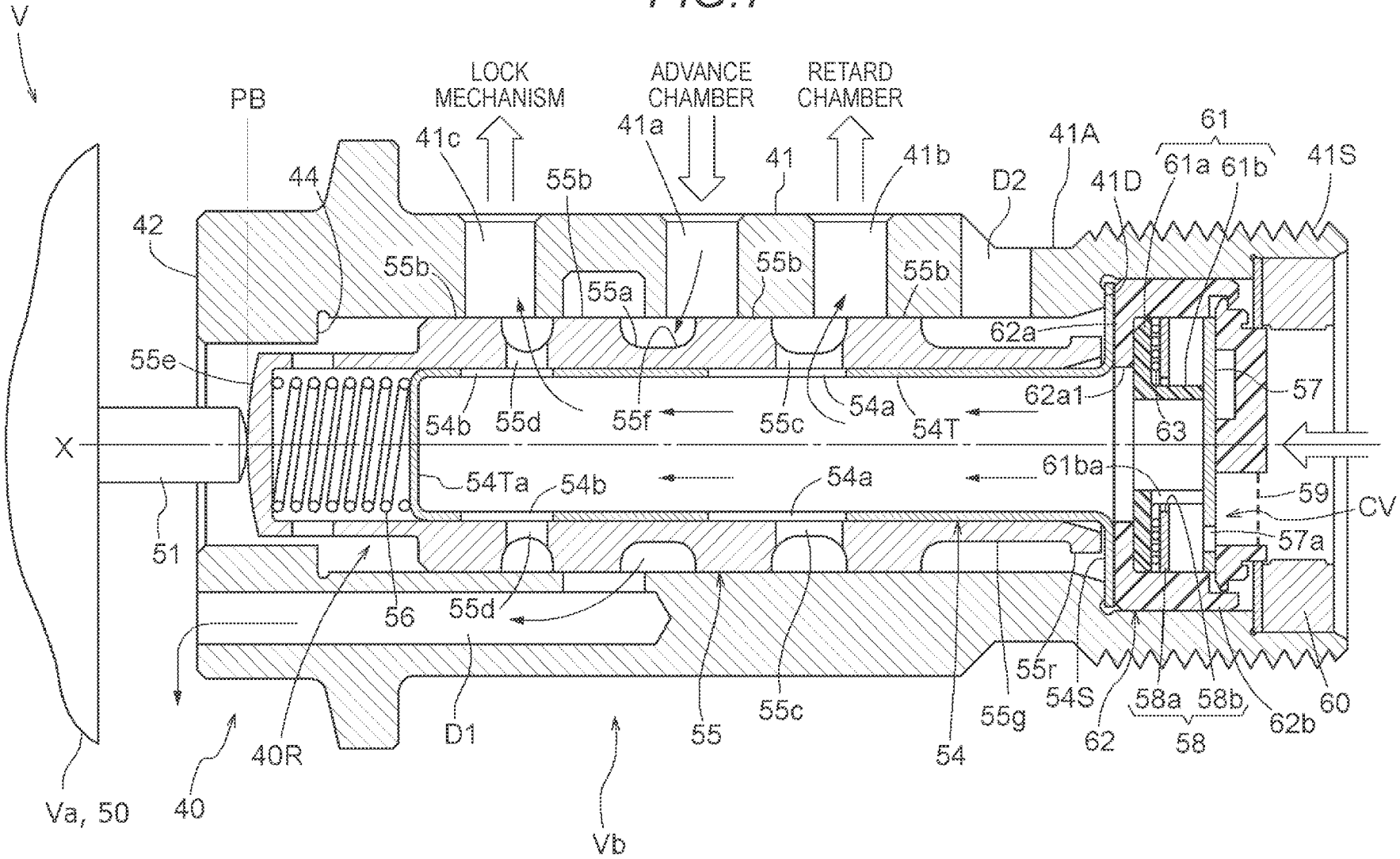
FIG. 7 is a cross-sectional view of the valve unit in which the spool is in a retard position.

When the spool 55 is operated to the retard position PB, as shown in FIG. 7, the working oil supplied from the hydraulic pump P is sent to the retard port 41*b* through the intermediate hole portion 55*c* of the spool 55, and is further supplied to the retard chamber Cb from the retard flow path 34. At the same time, the working oil in the advance chamber Ca flows from the advance flow path 33 to the advance port 41*a*, and is discharged from the first drain flow path D1 through the intermediate annular groove 55*f* of the spool 55.

In this way, in any of the four operation positions, the working oil of the lock mechanism L and the working oil of the advance chamber Ca or the retard chamber Cb are not discharged to the first drain flow path D1 at the same time, and the same applies to the second drain flow path D2. Therefore, it is possible to smoothly discharge the working oil from the lock mechanism L and to reliably shift to the lock state. In addition, it is possible to smoothly discharge the working oil from the advance chamber Ca or the retard chamber Cb to improve the responsiveness of the phase control.

As described above, as an opening and closing timing suitable for starting the engine E, a control for shifting to the intermediate lock phase M is performed at the time of stop control of the engine E. At the time of stop control of the engine E, by stopping the electric power supplied to the solenoid portion 50 of the electromagnetic unit Va, the position of the spool 55 is shifted from any of the operation position of the second advance position PA2, the neutral position PN or the retard position PB to the first advance position PA1.

In the present embodiment, as shown in FIGS. 4 and 8, when the lock mechanism L is in the lock state after shifting to the first advance position PA1, a flow path cross-sectional area A1 of the first supply port 54*a* of the fluid supply pipe 54 communicating with the intermediate hole portion 55*c* of the spool 55 (sum of flow path cross-sectional areas A1 of the plurality of first supply ports 54*a*) is smaller than a flow path cross-sectional area A2 of the advance port 41*a* communicating with the intermediate hole portion 55*c* of the spool 55 (sum of flow path cross-sectional areas A2 of the plurality of advance ports 41*a*). That is, since the first supply port 54*a* of the fluid supply pipe 54 is narrowed down, a flow rate of the working oil supplied to the advance chamber Ca per unit time is smaller than that when the first supply port 54*a* is fully opened. As a result, it is possible to ensure a period until the relative rotation phase becomes the intermediate lock phase M, and the working oil can be reliably discharged from the lock mechanism L during that period.

In the present embodiment, the first drain flow path D1 through which the working oil is discharged from the advance chamber Ca through the spool 55 and the second drain flow path D2 through which the working oil is discharged from the retard chamber Cb through the spool 55 extend in directions intersecting each other at different positions in the rotation axis X direction of the coupling bolt 40. As a result, it is possible to sufficiently ensure locations for providing the drain flow paths D1 and D2 on the coupling bolt 40, and it is possible to increase a flow path cross-sectional area of the first drain flow path D1 and the second drain flow path D2. Therefore, the flow path cross-sectional area of the drain flow paths D1 and D2 through which the working oil is discharged from the advance chamber Ca or the retard chamber Cb can be increased to improve the responsiveness of the phase control. In addition, since the discharge of the working oil from the lock mechanism L is also used in the first drain flow path D1, it is not necessary to separately provide a lock drain flow path extending in the rotation axis X direction of the coupling bolt 40, so that a sufficient flow path cross-sectional area of the first drain flow path D1 can be ensured. As a result, the working oil can be reliably discharged from the lock mechanism L during the period until the relative rotation phase becomes the intermediate lock phase M.

Further, in the present embodiment, as shown in FIG. 8, when the spool 55 shifts from the second advance position PA2 to the first advance position PA1 (the lock mechanism L shifts from the lock release state to the lock state), a timing at which the opening area of the second supply port 54*b* communicating with the spool 55 decreases (a second advance position PA2 side of the boundary position between the second advance position PA2 and the first advance position PA1 in the figure) is earlier than a timing at which the opening area of the first supply port 54*a* communicating with the spool 55 decreases (a boundary position between the second advance position PA2 and the first advance position PA1 in the figure). In other words, a timing at which the second supply port 54*b* is narrowed down from a maximum flow path cross-sectional area communicating with the lock port 41*c* through the spool 55 is earlier than a timing at which the first supply port 54*a* is narrowed down from the maximum flow path cross-sectional area communicating with the advance port 41*a* through the spool 55. In this way, by advancing the timing of reducing the supply of the working oil to the lock mechanism L, it is possible to reliably shift from the lock release state to the lock state during the period until the relative rotation phase becomes the intermediate lock phase M.

Other Embodiments (1) If the first drain flow path D1 and the second drain flow path D2 in the above-described embodiment extend in directions intersecting each other at different positions in the rotation axis X direction, the first drain flow path D1 may be inclined with respect to the rotation axis X direction, or the second drain flow path D2 may be inclined with respect to the radial direction.

(2) In the above-described embodiment, the bolt body 41 is fixed to the intake camshaft 5 by screwing the male screw portion 41S formed on the bolt body 41 of the coupling bolt 40 as a tubular valve case into the female screw portion 5S of the intake camshaft 5. Alternatively, for example, the valve unit Vb and the check valve CV may be housed in the tubular valve case fixed to the intake camshaft 5 by press-fitting or the like.

(3) The lock mechanism L in the above-described embodiment may adopt a configuration in which the relative rotation phase can be restrained by the most advanced phase or the most retarded phase.

(4) The first advance position PA1 described above may be set as the movement end position of the spool 55, and the retard position PB may be set as the movement start position of the spool 55. When the retard position PB is the movement end position of the spool 55, a lock mode may be provided in which, in cooperation with the discharge of the working oil from the advance chamber Ca and the supply of working oil to the retard chamber Cb, the working oil of the lock recess 27 flows from the lock control flow path 35 to the lock port 41*c* and is discharged from the first drain flow path D1 through the intermediate annular groove 55*f* of the spool 55. In this case, the working oil from the advance chamber Ca and the working oil from the lock mechanism L are discharged from the first drain flow path D1 at the same time. The spool 55 has five operation positions in which a lock mode at the retard position is added to the above four operation positions.

(5) As compared with the embodiment described above, the valve unit Vb may be configured such that the arrangement of the advance port 41*a* and the retard port 41*b* is reversed.

(6) The lock mechanism L in the embodiment described above can be restrained by any one of the intermediate lock phase M, the most retarded phase, and the most advanced phase. Alternatively, the lock mechanism L may be a multi-lock system capable of restraining the relative rotation phase at a plurality of phases.

Embodiments disclosed here can be used in a valve opening and closing timing control device that controls a relative rotation phase between a drive-side rotary body and a driven-side rotary body by fluid pressure.

A characteristic configuration of a valve opening and closing timing control device according to an aspect of this disclosure resides in that the valve opening and closing timing control device includes a drive-side rotary body that rotates synchronously with a crankshaft of an internal combustion engine; a driven-side rotary body that is provided inside the drive-side rotary body in a state of being coaxial with a rotation axis of the drive-side rotary body and that rotates integrally with a camshaft for opening and closing a valve; an advance chamber and a retard chamber formed between the drive-side rotary body and the driven-side rotary body; a lock mechanism that is switchable between a lock state in which a relative rotation phase of the driven-side rotary body with respect to the drive-side rotary body is restrained to an intermediate phase between a most retarded phase and a most advanced phase and a lock release state in which the restraint of the intermediate phase is released; a valve unit that includes a fluid supply pipe into which fluid is supplied and a spool movable along a direction of the rotation axis on an outer peripheral side of the fluid supply pipe, and that controls supply of the fluid to and discharge of the fluid from the lock mechanism, the advance chamber, and the retard chamber; and a tubular valve case that has an internal space extending along the rotation axis inside the driven-side rotary body in a radial direction and that houses the valve unit in the internal space. A first opening portion through which the fluid is suppliable to the advance chamber and the retard chamber is formed in the fluid supply pipe, a second opening portion that is communicative with the first opening portion through the spool and that communicates with any one of the advance chamber and the retard chamber is formed in the valve case. When the lock mechanism is in the lock state, a flow path cross-sectional area of the first opening portion communicating with the spool is smaller than a flow path cross-sectional area of the second opening portion communicating with the spool.

In this configuration, since the valve unit is provided in the internal space of the valve case along the rotation axis direction inside the driven-side rotary body in the radial direction, a compact size of the device can be achieved compared with a case where the valve unit is provided outside the driven-side rotary body. In this configuration, since the valve unit including the fluid supply pipe and the spool controls the supply of the fluid to and discharge of the fluid from the lock mechanism, the advance chamber and the retard chamber, similar to the valve opening and closing timing control device described in Reference 2, a more compact size can be achieved.

In this configuration, in the valve case, the second opening portion that is communicative with the first opening portion of the fluid supply pipe into which the fluid is supplied and that communicates with, for example, the advance chamber, is formed in the valve case. When the lock mechanism is in the lock state, the flow path cross-sectional area of the first opening portion is smaller than the flow path cross-sectional area of the second opening portion. That is, since the first opening portion of the fluid supply pipe is narrowed down, a fluid amount supplied to the advance chamber is smaller than when the first opening portion is fully opened. As a result, it is possible to ensure a period until the relative rotation phase becomes an intermediate phase, and the fluid can be reliably discharged from the lock mechanism during that period. Therefore, a valve opening and closing timing control device that can reliably shift to the lock state while achieving the compact size of the device can be provided.

Another characteristic configuration resides in that, when the lock mechanism is in the lock state, the spool is in at least one of a movement start position and a movement end position.

As in this configuration, if the spool is in the lock state when the spool is in the movement start position or the movement end position, positions of the drain flow path can be easily set.

Another characteristic configuration resides in that a third opening portion through which the fluid is suppliable to the lock mechanism is formed in the fluid supply pipe, a fourth opening portion that is communicative with the third opening portion through the spool and that communicates with the lock mechanism is formed in the valve case. When the lock mechanism shifts from the lock release state to the lock state, a timing at which the third opening portion is narrowed down from a maximum flow path cross-sectional area communicating with the fourth opening portion through the spool is earlier than a timing at which the first opening portion is narrowed down from a maximum flow path cross-sectional area communicating with the second opening portion through the spool.

As in this configuration, by advancing the timing of reducing the supply of the fluid to the lock mechanism, it is possible to reliably shift from the lock release state to the lock state during the period until the relative rotation phase becomes the intermediate phase.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control device comprising:

a drive-side rotary body that rotates synchronously with a crankshaft of an internal combustion engine;

a driven-side rotary body that is provided inside the drive-side rotary body in a state of being coaxial with a rotation axis of the drive-side rotary body and that rotates integrally with a camshaft for opening and closing a valve;

an advance chamber and a retard chamber formed between the drive-side rotary body and the driven-side rotary body;

a lock mechanism that is switchable between a lock state in which a relative rotation phase of the driven-side rotary body with respect to the drive-side rotary body is restrained to an intermediate phase between a most retarded phase and a most advanced phase and a lock release state in which the restraint of the intermediate phase is released;

a valve unit that includes a fluid supply pipe into which fluid is supplied and a spool movable along a direction of the rotation axis on an outer peripheral side of the fluid supply pipe, and that controls supply of the fluid to and discharge of the fluid from the lock mechanism, the advance chamber, and the retard chamber; and a tubular valve case that has an internal space extending along the rotation axis inside the driven-side rotary body in a radial direction and that houses the valve unit in the internal space, wherein a first opening portion through which the fluid is suppliable to the advance chamber and the retard chamber is formed in the fluid supply pipe, a second opening portion that is communicative with the first opening portion through the spool and that communicates with any one of the advance chamber and the retard chamber is formed in the valve case, and when the lock mechanism is in the lock state, a flow path cross-sectional area of the first opening portion communicating with the spool is smaller than a flow path cross-sectional area of the second opening portion communicating with the spool.

2. The valve opening and closing timing control device according to claim 1, wherein when the lock mechanism is in the lock state, the spool is in at least one of a movement start position and a movement end position.

3. The valve opening and closing timing control device according to claim 1, wherein a third opening portion through which the fluid is suppliable to the lock mechanism is formed in the fluid supply pipe, a fourth opening portion that is communicative with the third opening portion through the spool and that communicates with the lock mechanism is formed in the valve case, and when the lock mechanism shifts from the lock release state to the lock state, a timing at which the third opening portion is narrowed down from a maximum flow path cross-sectional area communicating with the fourth opening portion through the spool is earlier than a timing at which the first opening portion is narrowed down from a maximum flow path cross-sectional area communicating with the second opening portion through the spool.

4. The valve opening and closing timing control device according to claim 2, wherein a third opening portion through which the fluid is suppliable to the lock mechanism is formed in the fluid supply pipe, a fourth opening portion that is communicative with the third opening portion through the spool and that communicates with the lock mechanism is formed in the valve case, and when the lock mechanism shifts from the lock release state to the lock state, a timing at which the third opening portion is narrowed down from a maximum flow path cross-sectional area communicating with the fourth opening portion through the spool is earlier than a timing at which the first opening portion is narrowed down from a maximum flow path cross-sectional area communicating with the second opening portion through the spool.

* * * * *